US008157285B2

(12) United States Patent
Wasserman

(10) Patent No.: US 8,157,285 B2
(45) Date of Patent: Apr. 17, 2012

(54) SNOWBOARD WITH RETRACTABLE BRAKING DEVICE

(76) Inventor: Randall T. Wasserman, San Diego, CA (US)

( * ) Notice: Subject to any disclaimer, the term of this patent is extended or adjusted under 35 U.S.C. 154(b) by 323 days.

(21) Appl. No.: 11/900,302

(22) Filed: Sep. 10, 2007

(65) Prior Publication Data

US 2009/0066043 A1 Mar. 12, 2009

(51) Int. Cl.
*A63C 7/00* (2006.01)

(52) U.S. Cl. ..... 280/604; 280/14.22

(58) Field of Classification Search ..... 280/604, 280/14.21, 14.22
See application file for complete search history.

(56) References Cited

U.S. PATENT DOCUMENTS

| | | | | |
|---|---|---|---|---|
| 4,109,931 | A * | 8/1978 | Woitschatzke et al. | 280/605 |
| 4,194,758 | A * | 3/1980 | Svoboda et al. | 280/605 |
| 4,453,731 | A * | 6/1984 | Krob | 280/605 |
| 4,674,764 | A * | 6/1987 | Miesen | 280/604 |
| 5,004,261 | A * | 4/1991 | Holzl | 280/612 |
| 5,356,168 | A * | 10/1994 | Ozburn | 280/605 |
| 5,516,126 | A * | 5/1996 | Myers | 280/14.28 |
| 6,139,031 | A | 10/2000 | Wingard | |
| 6,279,924 | B1 | 8/2001 | Murphy et al. | |
| 6,626,443 | B2 * | 9/2003 | Lafond | 280/14.24 |
| 6,695,323 | B2 | 2/2004 | Backlund | |
| 6,702,315 | B2 * | 3/2004 | Barbieri et al. | 280/605 |
| 6,935,640 | B2 | 8/2005 | Gille et al. | |
| 6,971,483 | B2 * | 12/2005 | Houston | 188/8 |
| 2004/0007838 | A1 * | 1/2004 | Farmer | 280/14.27 |
| 2004/0036257 | A1 * | 2/2004 | Lille et al. | 280/604 |
| 2005/0062240 | A1 * | 3/2005 | Holt | 280/28.11 |
| 2007/0096432 | A1 * | 5/2007 | Wilson | 280/604 |

* cited by examiner

*Primary Examiner* — Katy M Ebner
(74) *Attorney, Agent, or Firm* — The Nath Law Group; Laurie A. Axford

(57) ABSTRACT

A snowboard with retractable braking device includes a board member with a brake member reversibly pivotal through a hole in the board member. When retracted, the bottom surface of the brake member is flush with, or above, the bottom surface of the board member. A retractor, such as a torsional spring, may resiliently hold the brake member in a retracted position. Also provided is a snowboard with an automatically deployable retractable braking device which deploys when the rider falls off a pressure pad affixed to the board member. Also provided is a braking device for boards that glide on snow, and an automatically deployable braking device for boards that glide on snow.

9 Claims, 6 Drawing Sheets

SNOWBOARD WITH RETRACTABLE BRAKING DEVICE

FIELD OF THE INVENTION

The present invention relates generally to devices that allow a user to glide over snow, and more particularly to snowboards. Specifically, the present invention relates to snowboards with braking devices.

BACKGROUND

Riders of traditional snowboards are secured to the board by bindings or straps. When the snowboard is pointed directly down the slope with its bottom surface flat on the surface of the snow, it will quickly gather speed. The only way to effectively slow down a traditional snowboard is to aim the board across the slope and tilt it so that the edge of the board abrades the surface of the snow. This is a difficult maneuver for a novice snowboarder to perform without falling and risking injury. Thus, a problem with traditional snowboards is that novices must learn to perform turns in order to control their rate of descent. However, turning is a difficult maneuver to master and many novices are injured attempting to turn the snowboard to slow it down.

Another problem with existing snowboards is the necessity of securing the rider's feet to the board with bindings that must be used with large, generally uncomfortable boots. Although bindings and boots are cumbersome, riders of conventional snowboards are forced to use them to perform turns in order to slow down. Furthermore, because the bindings secure both feet to the board, it is difficult to move on a flat surface. To do so, the rider must manually disengage one binding to release a foot in order to push off on the snow, which leaves one foot secured in the binding bent at an uncomfortable, unnatural angle. Thus, a traditional snowboard's requirement of bindings and boots can make snowboarding an unpleasant experience for many snowboarders, particularly novices unaccustomed to using them.

Yet another problem with existing snowboards is that the riders are forced to stand in a fixed, sideways stance. Not only is this stance awkward and uncomfortable, it limits the rider's field of vision. Skiers, by contrast, have a better field of vision because they stand with both feet facing down the hill.

A further problem with traditional snowboards is that they cannot be ridden safely without bindings. As explained above, a rider of a traditional snowboard cannot slow down without performing turns, and turns cannot be performed without bindings. Furthermore, if the rider fell off the snowboard, nothing would prevent it from sliding down the hill without the rider, posing a serious danger to people below.

Attempts at solving some of these problems have been made. For example, a braking device for a snowboard is found in U.S. Patent Application Publication No. 2004/0036257. However, the device disclosed therein suffers from at least two disadvantages. First, the position of the brake is fixed and cannot be modulated while the user is riding the snowboard. Second, the brake blade will tend to clog with snow and ice, eventually rendering it ineffective.

Another attempt at providing a braking device for a snowboard-like apparatus is found in U.S. Pat. No. 6,935,640. However, this device is also prone to build-up of snow and ice that hinders operation of the mechanism.

Yet another existing braking device is disclosed in U.S. Pat. No. 6,139,031. This device, however, is operated by an elongated handle mounted in front of the rider. One disadvantage of this device is the danger posed by the handle during a fall.

If the rider falls forward, the rider's abdomen, chest, neck, or head is likely to strike the handle, possibly resulting in serious injury.

Accordingly, there is a need for a snowboard with a braking device that is not prone to clogging with snow or ice and that the user can modulate while riding without using a potentially dangerous handle. There is also a need for a snowboard that does not require the use of bindings so that the rider is not limited to a single fixed stance defined by the location of the bindings. Finally, there is a need for an automatically deployable braking device that would prevent a bindingless snowboard from sliding uncontrollably down the slope without the rider.

SUMMARY OF THE INVENTION

The present invention provides a braking device for snowboards that addresses these needs.

According to one embodiment of the present invention, a snowboard with a retractable braking device is provided. The snowboard includes a board member with a top surface having a riding section. A brake member having solid top, bottom, and lateral surfaces is pivotally connected to the board so that it can pivot through a hole in the riding section of the board member between a retracted position and a deployed position. In one embodiment, the brake member is generally wedge-shaped and the pivotal connection to the board is located on the narrow end of the wedge.

In the retracted position, the bottom surface of the brake is flush with the bottom surface of the board member. In an alternative configuration, the bottom surface of the brake member retracts above the bottom surface of the board member when the braking device is in the retracted position. In the deployed position, the bottom surface of the brake protrudes through the hole and below the bottom surface of the snowboard.

In one embodiment, a retractor resiliently holds the brake in the retracted position and provides resistance against inadvertent deployment of the brake. In an exemplary embodiment the retractor is a spring-loaded hinge. Alternatively, it is a tang, torsional spring, or other device capable of resiliently holding the brake in the retracted position. In some embodiments, a brake stop is provided which prevents the brake from retracting beyond the fully retracted position.

According to another embodiment of the present invention, a snowboard with an automatically deployable retractable braking device is provided. This embodiment further includes an automatic brake deployment mechanism operatively connected to a pressure pad which is mounted in the riding section of the board member. When the pressure pad is depressed, the brake deployment mechanism is deactivated. When the pressure pad is released, the brake deployment mechanism is activated and causes the brake to automatically deploy. The pressure pad may be operated by mechanical means and/or may include an electric force transducer. In one embodiment, the automatically deployable braking device further includes a retractor that resiliently holds the brake flush with the bottom surface of the board member when the brake is in the retracted position. Alternatively, this retractor holds the brake above the bottom surface of the board member when the brake is in the retracted position.

In another embodiment of the present invention, a snowboard with automatically deployable retractable braking device further includes a second automatically deployable braking device that is structurally identical to the first braking device, although it may be oriented in the opposite direction as the first braking device. The second braking device is automatically deployable by the brake deployment mechanism in the same way as the first braking device. In an exemplary embodiment, this second braking device includes a second retractor.

The brake deployment mechanism may comprise a first slider slidably attached to the bottom surface of a mechanical pressure pad. The first slider is pivotally connected to two linkages. One linkage is pivotally connected to the board, and the other is pivotally connected to a second slider which is slidably attached to the board. Attached to the second slider is an actuator which releasably engages a cam on the brake when the brake deployment mechanism is activated by a release of pressure on the pressure pad. When the cam and brake are engaged, the brake is essentially locked in the deployed position. The actuator disengages from the cam when the pressure pad is depressed, thus unlocking the brake allowing the rider to manually deploy it as needed.

BRIEF DESCRIPTION OF THE DRAWINGS

The present invention will be better understood with a detailed description of some exemplary embodiments of the invention, with reference to the accompanying drawings, in which like reference numerals refer to like parts, and in which.

DETAILED DESCRIPTION

Figure 1:
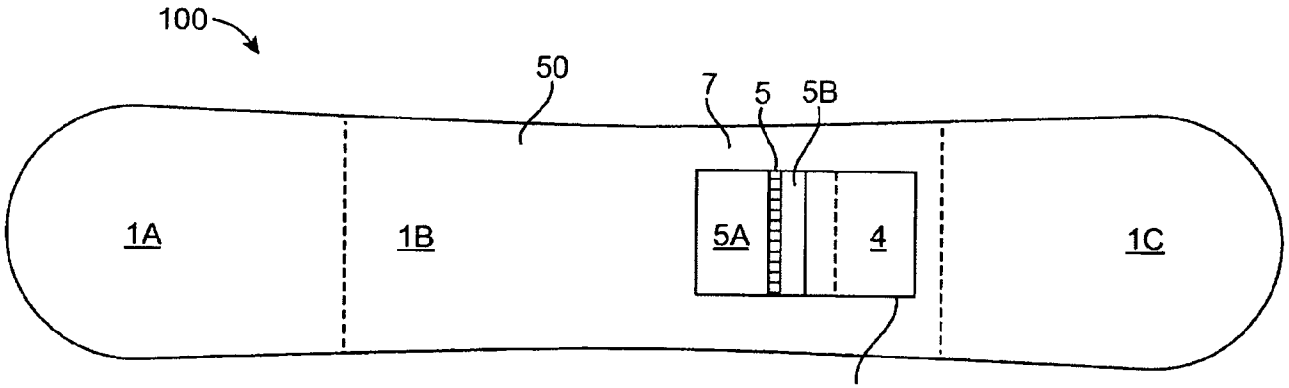
FIG. 1 is a top plan view of a snowboard with retractable braking device, according to a first exemplary embodiment of the present invention.

The present invention provides a retractable braking device for snowboards, as well as a snowboard equipped with a braking device. The braking device is attached to the board member and comprises a brake member that is reversibly pivotal through the board member. All surfaces of the brake member are solid. When the braking device is not activated, the bottom surface of the brake member is in a retracted position, flush with the bottom surface of the board member. As used herein, the bottom surface of the brake member is "flush with" the bottom surface of the board member if the two surfaces are parallel or within ten degrees of being parallel. To activate the braking device and slow down, the rider of the snowboard uses a foot to depress the brake member, which causes the bottom surface of the brake member to extend beyond the bottom surface of the board member into a deployed position. This creates extra drag on the snow, thus slowing the snowboard's rate of descent.

Also provided is an automatically deployable braking device for snowboards. A pressure pad attached to the board member is sensitive to the presence or absence of a rider. If the rider is standing on the pressure pad, the braking device is activatable by the rider. If the rider is not standing on the pressure pad, such as when the rider falls off the snowboard, the pressure pad triggers a brake deployment device which automatically deploys the brake member.

The advantages of the present invention are numerous. First, it allows novice snowboarders to control their rate of descent without performing turns. Furthermore, because a rider of a snowboard equipped with the braking device of the present invention no longer must perform turns to slow down, the need for bindings (which facilitate turning) is eliminated. Thus, another advantage of the present invention is that snowboarders will be able to snowboard without cumbersome bindings and uncomfortable boots. Snowboarders will also be able to perform tricks and maneuvers that are impossible on a board to which they are fixedly secured. Also, snowboarders will be able to stand in any position they desire, not just the awkward sideways stance required by existing snowboards. For example, a rider of a snowboard equipped with the braking device of the present invention can stand in a more comfortable parallel stance, with both feet pointed toward the front of the board, thus improving the rider's field of vision. Furthermore, because the rider's feet need not be fixed in place, moving along a flat surface does not require the rider to disengage a binding—the rider can push off with one foot in the snow in a manner similar to a skateboarder riding a skateboard, or simply pick up the board and walk.

The automatically deployable braking device of the present invention allows a rider to modulate the brake member with a foot while riding, and also ensures the board will not slide down the hill if the rider falls. When a rider standing on the pressure pad falls off the board, the pressure pad triggers the brake deployment mechanism which locks the brake member in a deployed position. With the brake member thus deployed, the snowboard will not descend the slope without the rider.

The board member of the snowboard may be identical to those of conventional snowboards. However, it may also be significantly longer and wider than those of conventional snowboards, which have an effective maximum size limit because riders must be able to turn them to slow down. As the present invention provides a braking device for snowboards, the effective size limit of conventional snowboards is irrelevant—even if the board member is too large for the rider execute sharp turns, the rider can use the braking device to slow down.

The sides of the board member may be substantially parallel, but in an exemplary embodiment the middle portion is narrower than the front and rear. The board member also has a hole through it to accommodate a reversibly pivotable brake member. The board member is manufactured using conventional snowboard construction techniques and materials. The top surface of the board member may comprise non-slip material or texture to provide the rider with better traction.

The brake member is reversibly pivotable through a hole in the board member. In order to prevent clogging with ice and snow, every exterior surface of the brake member is solid. The top surface of the brake member may comprise non-slip material or texture to provide the rider with better traction. The bottom of the brake member, or the edge of the brake member opposite the pivoted edge, may be serrated or toothed in order to create more friction between the brake and the snow. The brake member is made from a relatively light and hard material, such as an aluminum alloy, that will not quickly wear down from braking. The brake member may be made from composite materials, or from a combination of plastics, composites, and metals. The brake member and the board member may be made from the same material.

The retractor provides a resilient force that restores the brake member to the fully retracted position when not activated by the rider. In the fully retracted position, the brake member is retracted flush with, or slightly above, the bottom surface of the board member. One end of the retractor is attached to the board member and the other end is attached to the brake member. The force provided by the retractor is generally proportional to the displacement angle of the activated brake member. The retractor may be a spring-loaded hinge with one plate attached to the board member and the other plate attached to the brake member. The hinge may be made from any suitable material, but preferably is made from a strong metal such as steel. The spring is also made from any suitable material, but is preferably made from any metal with a relatively long fatigue life. The retractor may also be a tang with its ends embedded or otherwise attached to the board member and the brake member. The tang is preferably made from any material with a long fatigue life.

To prevent the retractor from over-rotating the brake member beyond the fully retracted position, a brake stop may also be provided. The brake stop may be mounted on the board member or on the brake member itself. Alternatively, the hinge may be designed so that it cannot rotate beyond an angle corresponding to the fully retracted position of the brake. A brake stop mounted on the board member comprises a flange that engages with the brake member (or a flange or protrusion affixed to the brake member) when the brake member reaches the fully retracted position. The engagement of the brake stop and the brake member prevents the brake member from pivoting beyond the retracted position. Any number of brake stop members may be used.

Exemplary embodiments of the invention will now be described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide and enabling description of such embodiments. It is to be understood that the scope of the invention shall be defined by the appended claims, not by the specific embodiments described herein.

A first exemplary embodiment of a snowboard with retractable braking device is illustrated in FIG. 1. The snowboard 100 has a board member 50 with top surface 1 and bottom surface 2. The top surface 1 includes front section 1A, riding section 1B, and rear section 1C. The riding section 1B is where the rider stands when riding the snowboard 100. The top surface 1, bottom surface 2, and board member 50 may all be made of the same material, or may be made of different materials integrally formed together. The bottom surface 2 is the gliding surface of the snowboard 100. A hole 3 located entirely within the riding section 1B passes completely through the board member 50, through both the top surface 1 and the bottom surface 2. The hole 3 allows the braking device to interact with the snow upon which the snowboard 100 is gliding.

In this exemplary embodiment, the board member 50 is six feet long and fifteen inches wide at the waist, which is the narrowest portion of the board member. The nose and tail (i.e. front and rear, respectively) of the board member are each twenty-five inches wide at their widest points. It is to be understood, however, that these dimensions are merely illustrative and in various embodiments the board member may be smaller or larger to accommodate riders of all sizes. This configuration of a narrow waist and wide ends is known as sidecut and it makes the snowboard 100 more maneuverable. The core of the board member 50 is made from fiberglass laminated wood. The bottom surface 2 is made from ultra high molecular weight polyethylene to provide a smooth gliding surface that can be repaired if deeply scratched. Surrounding the perimeter of the board member 50 are steel edges that provide additional strength and stiffness for the structure. The edges also aid turning if the rider wishes to turn the snowboard 100.

Figure 2:
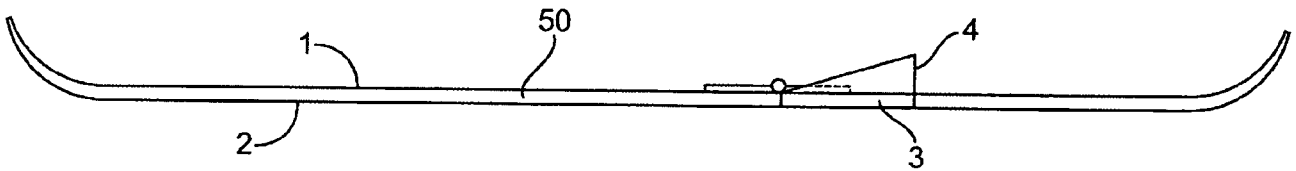
FIG. 2 is a side elevation view of the snowboard of FIG. 1, with the braking device in the retracted position.
Figure 3:
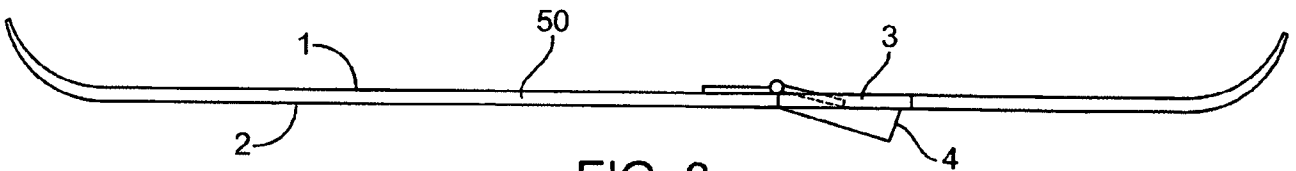
FIG. 3 is a side elevation view of the snowboard of FIG. 1, with the braking device in the deployed position.
Figure 4:
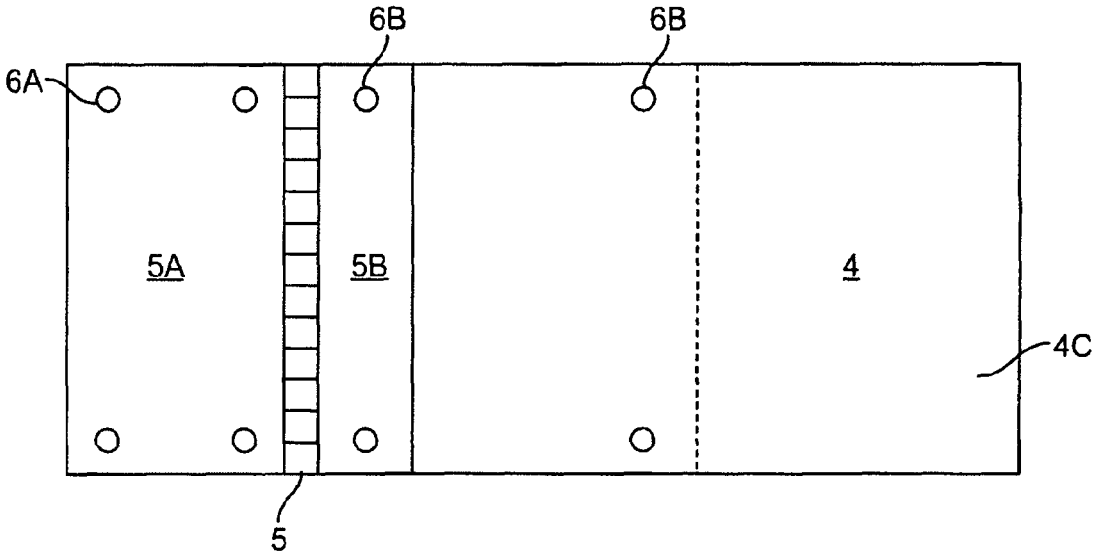
FIG. 4 is a top plan view of the brake and retractor of the braking device of the snowboard of FIG. 1.
Figure 5:
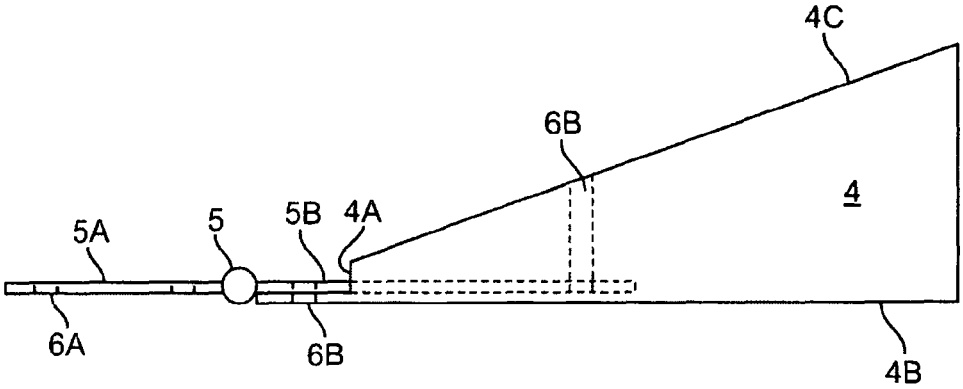
FIG. 5 is a side elevation view of the brake and retractor of FIG. 4.

Still referring to the exemplary embodiment illustrated in FIG. 1, the braking device includes a generally wedge-shaped brake member 4 that is pivotally connected to the board member 50. The brake 4 is completely solid, though in an alternative embodiment it is hollow with solid exterior surfaces. The narrow end 4A of the wedge is the front end of the brake 4 and is pivotally connected to the board member 50 within the riding section 1B adjacent to the front edge of the hole 3. Included in the pivotal connection is a retractor which, in this embodiment, is a spring-loaded hinge 5 with a front hinge plate 5A fixedly attached to the board member 50 within the riding section 1B, and a rear hinge plate 5B fixedly embedded in the front end 4A of the brake 4. The spring-loaded hinge 5 resiliently holds the brake 4 in a retracted position, as shown in FIG. 2. As shown in FIG. 3, When the rider applies sufficient force to the top surface of the brake 4C to overcome the resistance provided by the spring-loaded hinge 5, the rear hinge plate 5B rotates clockwise and the brake 4 pivots through the hole 3 into a deployed position.

To increase the strength of the attachment between the hinge 5 and the board member 50, mounting screws 6 are provided. Mounting screws 6A pass through the top surface 1 into the board member 50, and through the front hinge plate 5A, but do not pass through the bottom surface 2. Similar mounting screws 6B secure the rear hinge plate 5B to the end 4A of the brake 4. The mounting screws 6B pass through the holes in the rear hinge plate 5B and into the brake 4, but do not penetrate the bottom surface 4B of the brake 4. Adhesives are optionally used to further increase the strength of the attachment of the hinge plates.

In alternative embodiments, the front hinge plate 5A is fixedly attached to the top surface 1 or to the bottom surface 2. Also alternatively, the rear hinge plate 5B is fixedly attached to the top surface 4C or the bottom surface 4B of the brake 4. In another alternative embodiment, the plates of the hinge 5 are embedded in the board member 50 and the brake 4, and mounting screws may or may not be used.

The riding section 1B of the board member 50 and the top surface 4C of the brake 4 may have a non-slip surface to increase rider safety. The trailing edge of the bottom surface 4B of the brake 4 may be serrated to provide better bite with the snow when the brake is actuated by the rider. The depth of these serrations may be anywhere from a fraction of an inch to several inches, and in alternative embodiments there may be no serrations. Optionally, the bottom surface 4B of the brake 4 may itself have serrations. Depending on the size of the rider, the size of the brake 4 varies. However, for an average size person, the brake 4 is approximately six inches wide by eight inches long by four inches tall. In alternative embodiments the brake 4 may be as little as one-half inch wide or as much as approximately 80% of the width of the board member 50 at its waist.

The hole 3 and brake 4 are dimensioned such that the brake 4 is large enough that the rider can easily locate the brake 4 by feel, yet small enough that the board member 50 retains its structural integrity. If the hole 3 is too wide, the board will flex too much and possibly break in the vicinity of the hole 3. The brake 4 is slightly smaller than the hole 3 so that it can pivot through the hole 3 without scraping the edges. However, the brake 4 must not be too much smaller than the hole 3 in order to ensure that snow and ice do not build up on the edges of the hole 3. For example, in this exemplary embodiment, the hole 3 is approximately $1/16^{th}$ of an inch longer and wider than the brake 4. The offset 7 of the hole 3 from the edge of the board member 50 should be at least two inches in order to maintain structural integrity. In this embodiment, the offset 7 on each side of the hole 3 is four inches.

In this exemplary embodiment, the spring-loaded hinge 5 is made of steel. Depending on the weight of the intended rider, the spring constant of the spring-loaded hinge 5 varies. For example, in a braking device designed for a child's snowboard, the spring constant would be much smaller than if the braking device were designed for an adult's snowboard. The resilient force provided by the spring-loaded hinge 5 is approximately proportional to the angle through which the brake 4 rotates. Accordingly, small deflections of the brake 4 require the rider to apply a relatively small force, while large deflections require a proportionally larger force.

Figure 6:
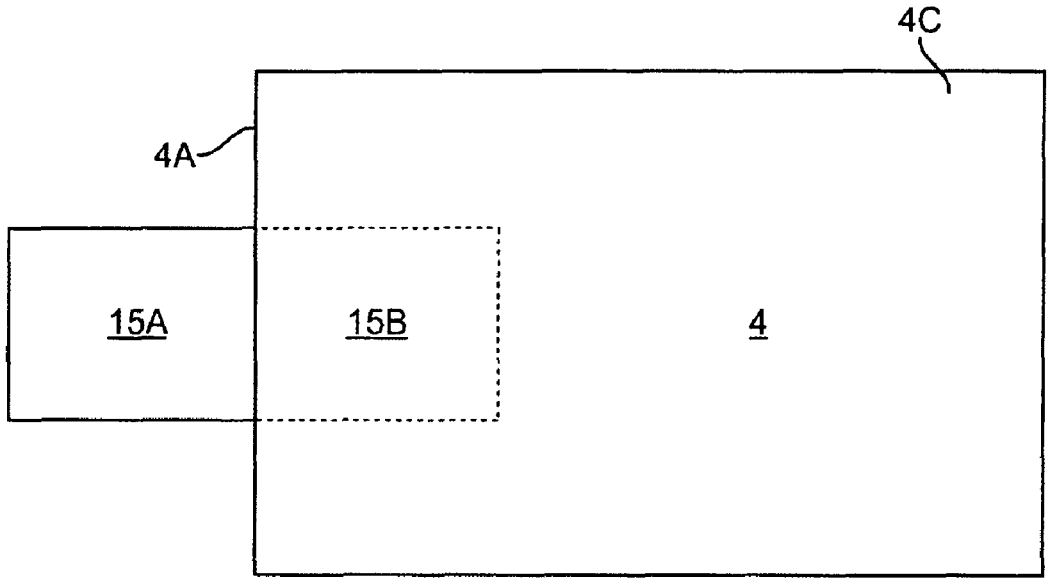
FIG. 6 is a top plan view of the brake and retractor of the braking device according to another embodiment of the invention.
Figure 7:
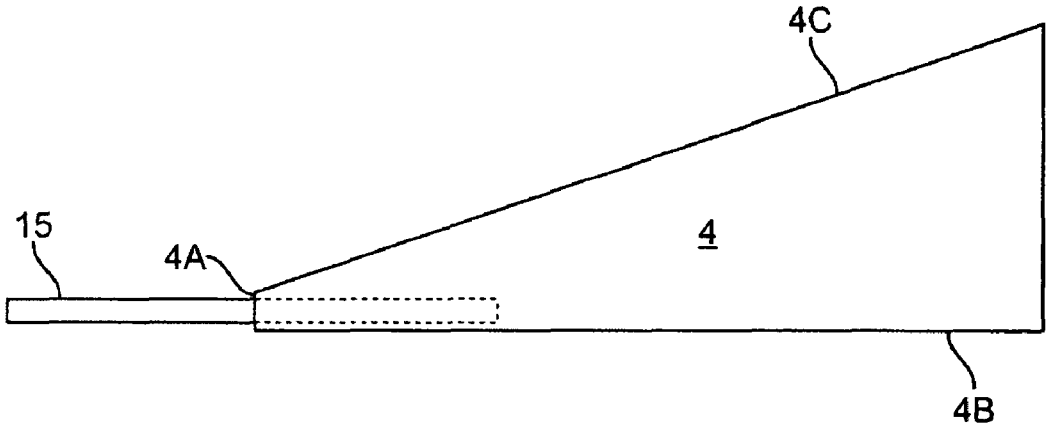
FIG. 7 is a side elevation view of the brake and retractor of FIG. 6.

A braking device according to an alternative embodiment of the present invention is illustrated in FIGS. 6 and 7. Instead of a spring-loaded hinge 5, the retractor comprises a flexible tang 15. The front end 15A of the tang 15 is fixedly embedded within the board member 50 while the rear end 15B is fixedly embedded in the thinner end 4A of the brake 4. A dowel pin is used to better secure the embedded ends of the tang 15. Similar to the attachment of the hinge 5, mounting screws 6 are optionally used to increase the strength of the attachment between the tang 15, the board member 50, and the brake 4.

Figure 8:
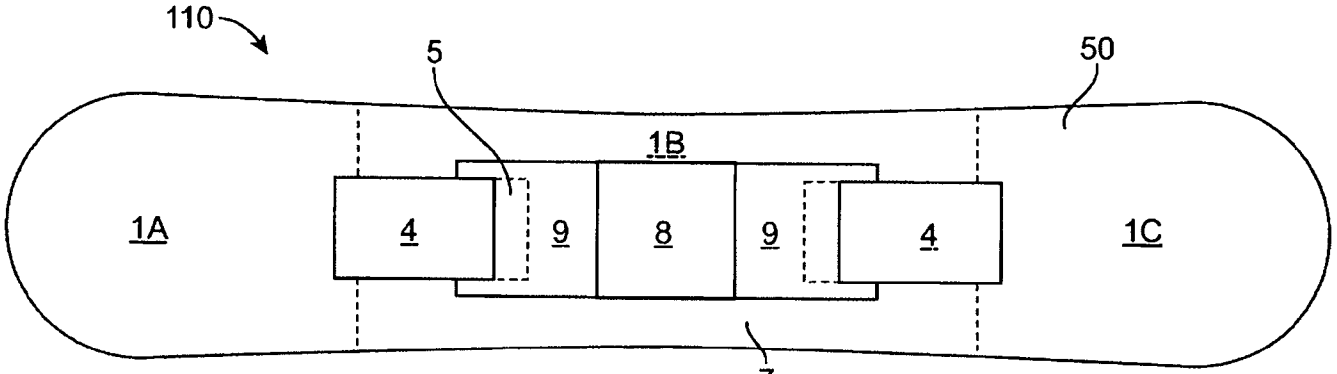
FIG. 8 is a top plan view of a snowboard with automatically deployable braking devices, according to a second exemplary embodiment of the present invention.
Figure 9:
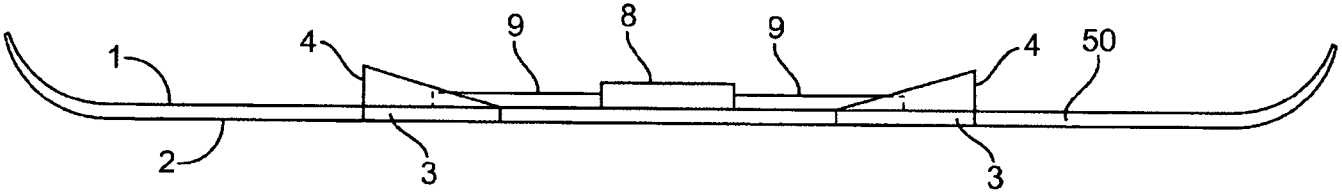
FIG. 9 is a side elevation view of the snowboard of FIG. 8, with the braking devices in the retracted position.
Figure 10:
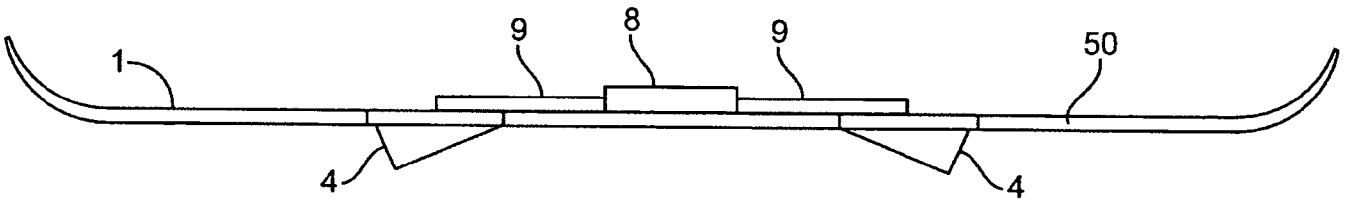
FIG. 10 is a side elevation view of the snowboard of FIG. 8, with the braking devices in the deployed position.
Figure 12:
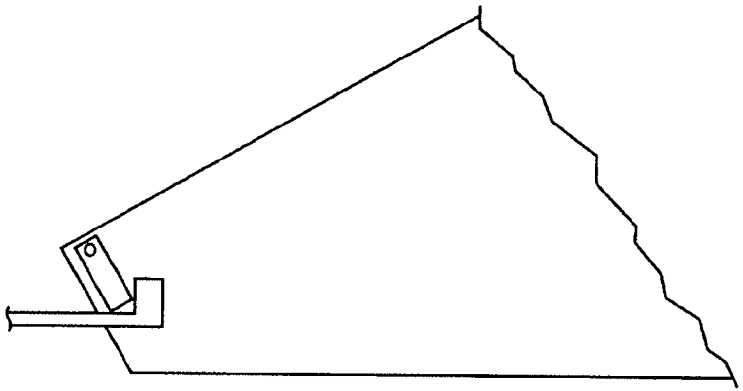
FIG. 12 is a partial side elevation view of the brake deployment mechanism of FIG. 11, showing the braking device in the retracted position.
Figure 11:
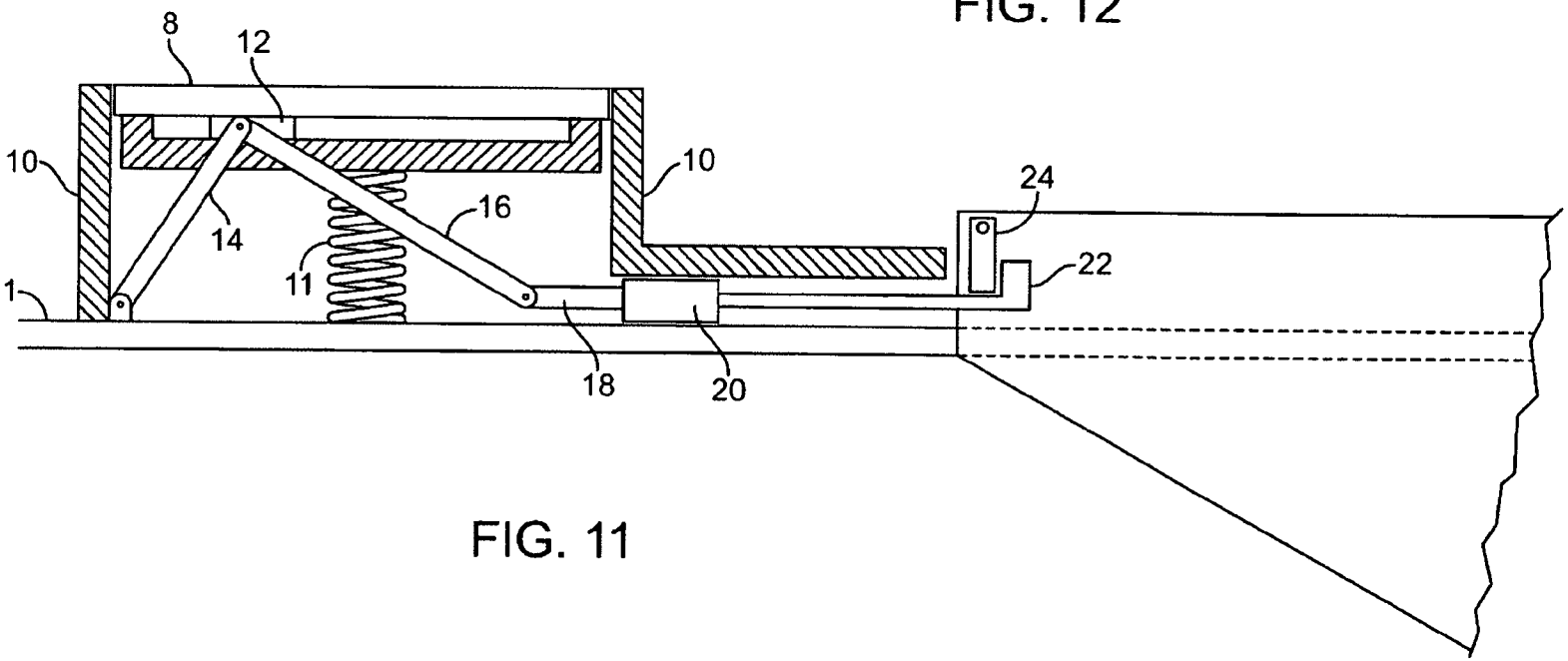
FIG. 11 is a side elevation cut-away view of the brake deployment mechanism of the snowboard of FIG. 8, showing the braking device in the deployed position.

As seen in FIG. 8, a snowboard 110 with an automatically deployable braking device is provided in a second exemplary embodiment of the present invention. Similar to the first exemplary embodiment, the braking device comprises a solid, wedge-shaped brake 4 with embedded spring-loaded hinge 5 that resiliently holds the brake 4 in the retracted position. However, in this embodiment, the hole 3 and brake 4 may be in any section of the top surface 1 of the board member 50. The snowboard 110 further comprises a pressure pad 8 mounted in the riding section 1B and a brake deployment mechanism 9 operatively connected to the pressure pad.

The brake deployment mechanism 9 includes a spring 11 with one end fixedly attached to the bottom of the pressure pad 8 and with the other end fixedly attached to the board member 50. The brake deployment mechanism 9 is contained in a housing 10, which both protects the mechanism from snow and ice and constrains movement of the pressure pad 8 to a path that is generally perpendicular to the plane of the top surface 1. The housing 10 is made from a strong material with low friction coating. In this embodiment, the housing is made from polytetrafluoroethylene coated aluminum.

A mechanical linkage allows for automatic deployment of the brake 4 when the pressure pad 8 is in the raised position. The first member 14 of the mechanical linkage has a first end pivotally connected to the board member 50. The second end of the member 14 is pivotally connected to a first slider 12 which is slidably mounted to the bottom of the pressure pad 8. Also pivotally connected to the first slider 12 is the first end of the second member 16 of the mechanical linkage. The second end of the second member 16 is pivotally connected to an extension 18 of a second slider 20. The extension 18 is fixedly attached to the second slider 20. Also fixedly attached to the second slider 20 is an actuator 22. The actuator 22 extends past the pivoted end of the brake 4. A cam 24 is fixedly attached to the lateral surface of the brake 4. The linkage members, the actuator, and the cam are made of steel.

When the pressure pad 8 is depressed by the rider, the first member 14 is forced to rotate clockwise, thus pushing the first slider 12 to slide toward the brake 4. As the pressure pad 8 moves downwardly and the first slider 12 moves toward the brake 4, the second member 16 is forced to simultaneously rotate counterclockwise and translate toward the brake 4. This translation of the second member 16 causes the extension 18 to also translate toward the brake 4. Because the extension 18 is fixedly attached to the second slider 20, the second slider 20 also translates toward the brake 4. The translation of the second slider 20 causes the actuator 22 to disengage from the cam 24. As the actuator 22 and the cam 24 disengage, the spring-loaded hinge 15 causes the brake 4 to rotate counterclockwise until it reaches the retracted position.

When the pressure pad 8 is in the lowered position and the brake 4 is thus in the retracted position, the actuator 22 has no effect on the brake 4 or the spring-loaded hinge 5, and the rider can modulate the brake 4. However, when the rider steps (or falls) off the pressure pad 8, the spring 11 will force the pressure pad 8 away from the top surface 1, thus engaging the actuator 22 with the cam 24. As the pressure pad 8 rises, the actuator 22 pulls on the cam 24 with sufficient force to overcome the resistance of the spring-loaded hinge 5. This causes the brake 4 to rotate clockwise into the deployed position. The engagement of the actuator 22 with the cam 24 essentially locks the brake 4 in the deployed position because the brake 4 can only rotate counterclockwise if the resistance provided by the spring 11 is overcome.

The spring constant of the spring 11 is much greater than the spring constant of the spring-loaded hinge 5. The ratio of these spring constants helps define the critical pressure required to hold the pressure pad in the depressed position. The higher the ratio of the spring constant of the spring 11 to that of the spring-loaded hinge 5, the greater the critical pressure required to keep the pressure pad depressed. In an exemplary embodiment designed for a rider of average size, the ratio of these spring constants is at least 3 to 1.

In some embodiments, the automatically deployable retractable braking device may incorporate two brake members 4, one behind the rider and one in front of the rider. The pivotal connections between the brake members 4 and the board member 50 are on the edges of the brake members 4 closest to the middle of the board member 50. In these embodiments, the brake deployment mechanism 9 is operatively connected to both brake members 4, such that both brake members deploy and retract simultaneously.

Figure 13:
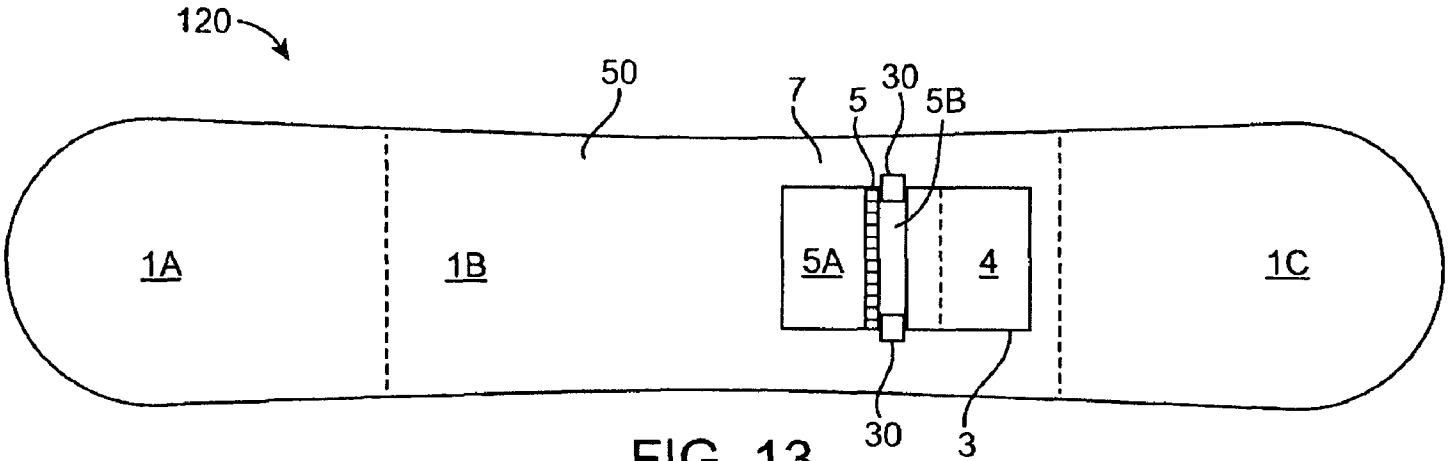
FIG. 13 is a top plan view of a snowboard with retractable braking device, according to another embodiment of the present invention.
Figure 14:
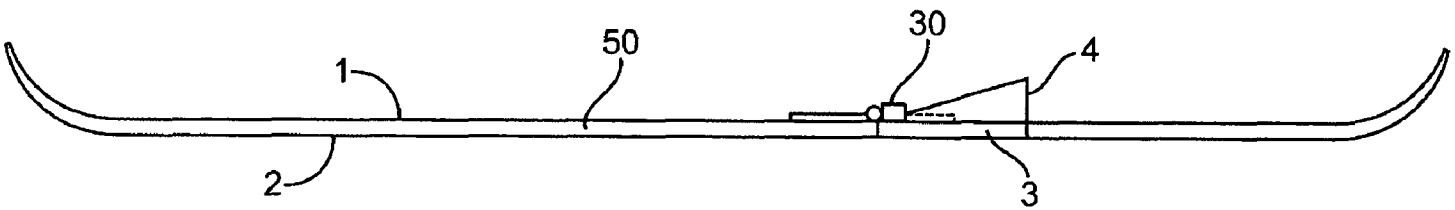
FIG. 14 is a side elevation view of the snowboard of FIG. 13.

In any of the foregoing embodiments, a brake stop 30 may be provided to prevent the retractor from causing the brake 4 to retract beyond the fully retracted position. As best seen in FIGS. 13 and 14, a snowboard 120 has two brake stops 30 affixed to the top surface 1 of the board member 50. The brake stops 30 are, in this embodiment, steel flanges affixed to top surface 1 adjacent to the sides of hole 3. In the illustrated embodiment, the brake stops 30 engage with the rear hinge plate 5B. Engagement occurs only when the brake 4 is in the fully retracted position, thus preventing it from pivoting any further. Alternatively, there may be any number of brake stops 30 at various locations on the top surface 1 adjacent to the hole 3, engaging with the hinge 5, the brake 4, a flange affixed thereto, or any combination of the preceding. Also alternatively, a flange affixed to the brake 4 may engage with the board member to prevent over-rotation. Also alternatively, the hinge 5 may be a stop hinge such that the moveable hinge plate 5B cannot rotate beyond an angle corresponding to the fully retracted position of the brake 4.

Various modifications and alterations of the invention will become apparent to those skilled in the art without departing from the spirit and scope of the invention, which is defined by the accompanying claims. The claims should be constructed with these principles in mind.

What is claimed is:

1. A snowboard with an automatically deployable retractable braking device, comprising:

a) a board member with an opening through a bottom surface and a top surface of the board member, the top surface comprising a riding section the board member;

b) a first automatically deployable braking device attached to the board member adjacent to the opening, comprising:

i) a first brake member reversibly pivotal through the opening in the board member; and ii) a pivotal connection between the first brake member and the board member;

c) a brake deployment mechanism, d) an operative connection between the brake deployment mechanism and the first brake member, e) a pressure pad mounted on the riding section of the board member, the pressure pad being translatable between a raised position and a lowered position; and f) an operative connection between the pressure pad and the brake deployment mechanism, g) a first slider slidably attached to the bottom surface of the pressure pad h) a first linkage member having a first end pivotally connected to the board member and a second end pivotally connected to the first slider, i) a second slider slidably attached to the board member, j) a second linkage member having a first end pivotally connected to the first slider and a second end pivotally connected to the second slider, wherein the brake deployment mechanism holds the bottom surface of the first brake member below the bottom surface of the board member when the pressure pad is in the raised position;

wherein the first brake member further comprises a cam, and wherein the brake deployment mechanism further comprises an actuator that engages with the cam when the pressure pad is in the lowered position; and wherein the actuator is engaged with the cam when the pressure pad is in the raised position, and wherein the actuator is disengaged from the cam when the pressure pad is in the lowered position.

2. The snowboard of claim 1, further comprising a first retractor that resiliently holds the bottom surface of the first brake member flush with the bottom surface of the board member when the pressure pad is in the lowered position.

3. The snowboard of claim 1, further comprising a first retractor that resiliently holds the bottom surface of the first brake member above the bottom surface of the board member when the pressure pad is in the lowered position.

4. The snowboard of claim 1, wherein the pressure pad comprises an electronic force transducer, and wherein the brake deployment mechanism is electronically activated by a signal generated by the force transducer.

5. The snowboard of claim 1, further comprising:

k) a second activatable braking device, comprising:

i) a second brake member reversibly pivotal through the board member, the second brake member mounted in front of the first brake member; and ii) a pivotal connection between the second brake member and the board member, l) an operative connection between the brake deployment mechanism and the second brake member, m) an operative connection between the pressure pad and the brake deployment mechanism, wherein the brake deployment mechanism holds the bottom surface of the second brake member below the bottom surface of the board member when the pressure pad is in the raised position.

6. The snowboard of claim 5, wherein the rear end of the second brake member is pivotally connected to the board member.

7. The snowboard of claim 5, wherein the first brake member and the second brake member are both reversibly pivotal through the riding section of the board member.

8. The snowboard of claim 5, further comprising a second retractor that resiliently holds the bottom surface of the second brake member flush with the bottom surface of the board member when the pressure pad is in the lowered position.

9. The snowboard of claim 5, further comprising a second retractor that resiliently holds the bottom surface of the second brake member above the bottom surface of the board member when the pressure pad is in the lowered position.

* * * * *